US008196703B2

(12) United States Patent
Stanley

(10) Patent No.: US 8,196,703 B2
(45) Date of Patent: Jun. 12, 2012

(54) EXHAUST COMPONENT

(76) Inventor: Ronald Lee Stanley, Redding, CA (US)

( * ) Notice: Subject to any disclaimer, the term of this patent is extended or adjusted under 35 U.S.C. 154(b) by 0 days.

(21) Appl. No.: 12/878,492

(22) Filed: Sep. 9, 2010

(65) Prior Publication Data

US 2011/0073405 A1 Mar. 31, 2011

Related U.S. Application Data

(60) Provisional application No. 61/246,429, filed on Sep. 28, 2009, provisional application No. 61/250,233, filed on Oct. 9, 2009.

(51) Int. Cl.
*F01N 1/08* (2006.01)

(52) U.S. Cl. ..... 181/268; 181/212; 181/264; 181/257; 181/232

(58) Field of Classification Search ..... 181/220, 181/232, 238, 239, 268, 264, 212, 257
See application file for complete search history.

(56) References Cited

U.S. PATENT DOCUMENTS

| | | | | | |
|---|---|---|---|---|---|
| 2,016,254 | A * | 10/1935 | Noblitt et al. | ..... | 181/251 |
| 3,478,842 | A * | 11/1969 | Mattie | ..... | 181/268 |
| 4,234,054 | A * | 11/1980 | Chapin | ..... | 181/252 |
| 4,252,212 | A * | 2/1981 | Meier | ..... | 181/248 |
| 5,033,581 | A * | 7/1991 | Feuling | ..... | 181/257 |
| 5,198,625 | A * | 3/1993 | Borla | ..... | 181/248 |
| 5,280,143 | A * | 1/1994 | Kakuta | ..... | 181/250 |
| 6,672,425 | B1 * | 1/2004 | Simmons | ..... | 181/252 |
| 6,755,279 | B2 * | 6/2004 | Kaneko et al. | ..... | 181/232 |
| 7,380,635 | B2 * | 6/2008 | Harris | ..... | 181/206 |
| 2005/0011698 | A1 * | 1/2005 | Bassani | ..... | 181/238 |

* cited by examiner

*Primary Examiner* — Forrest M Phillips
(74) *Attorney, Agent, or Firm* — Donald R. Boys; Central Coast Patent Agency, Inc.

(57) ABSTRACT

An exhaust component is provided including an inlet portion for accepting an exhaust stream entering therein from an exhaust system, two or more separator components fixed to the inlet portion for separating the exhaust stream into two or more streams at the point of egress from the inlet portion, two or more chambers fixed to the separator components, the chambers for muffling sound of the exhaust stream, two or more collector components fixed to the chambers opposite the separator components for collecting the separated exhaust streams upon egress from the chambers, and one or more outlet portions fixed to the collector components at the end opposite the chambers for carrying separated or merged exhaust streams out of the exhaust component.

6 Claims, 8 Drawing Sheets

EXHAUST COMPONENT

CROSS-REFERENCE TO RELATED DOCUMENTS

The present application claims priority to provisional application Ser. Nos. 61/246,429, filed Sep. 28, 2009, and 61/250,233, filed Oct. 9, 2009, the entire disclosures of the provisional applications are incorporated herein at least by reference.

BACKGROUND OF THE INVENTION

1. Field of the Invention

The present invention is in the field of vehicle exhaust systems and components and pertains particularly to methods and apparatus for processing exhaust gasses in an exhaust system to mitigate noise and improve sound quality.

2. Discussion of the State of the Art

In the field of exhaust systems products for vehicles, mufflers and stock resonators are available on the market for muffling and dampening noise from vehicle exhaust. A variety of different muffler or resonator products have been provided with a focus on cleaning up noise in the exhaust system and improving resonance and definition of the exhaust pulses, as they exist on the vehicle.

One problem with existing muffler products is that in addition to raising backpressure in the overall exhaust system, they can also create higher noise ratios and lower definition rates between sound pulses emanating from the exhaust system. One aspect of the problem is exposure to too many surface obstacles within the component that the exhaust pulses collide with. Wave collision (back on itself) and repetitive wave deflection or bouncing off of exhaust component surfaces may directly affect the quality of the exhaust sound in a negative manner.

Therefore, what is clearly needed is an exhaust component that can reduce noise ration within an exhaust system while maintaining a low backpressure within an exhaust system.

SUMMARY OF THE INVENTION

A problem stated above is that better sounding exhaust systems are desirable for any personal truck or automobile, but many of the conventional means for muffling or attenuating the sound of an exhaust system such as mufflers and resonators, also create higher noise ratios and lower definition rates between sound pulses emanating from the exhaust system. The inventors therefore considered functional elements of an exhaust system, looking for components that could be integrated and harnessed to provide exhaust sound definition and improvement but in a manner that would not create more backpressure.

Every vehicle is propelled by internal combustion, one by-product of which is an abundance of exhaust gases expelled from the engine under pressure. Most such engines employ exhaust headers and manifolds to conduct the exhaust gases from the exhaust ports of the engine to a more realistic point to expel the gases, and exhaust pipes, mufflers, and resonators are typically a part of such apparatus.

The present inventor realized in an inventive moment that if, at the point of expansion, exhaust gases could be caused to diverge in path and muffled while traveling separate paths and then be harmonically collected for a stereo output, better resonance and pulse definition in the overall exhaust sound might result. The inventor therefore constructed a unique type of exhaust component arrangement for exhaust systems that allowed gases to expand and flow unrestricted through two or more sound deadening devices and to be collected and merged at output from the exhaust system with minimal pulse wave collision or bouncing inside the exhaust pipe or exhaust components. A significant improvement in sound quality and definition of the exhaust pulses emanating from the exhaust pipes results with no impediment to gas expansion or gas flow created.

Accordingly, in an embodiment of the present invention, an exhaust component is provided including an inlet portion for accepting an exhaust stream entering therein from an exhaust system, two or more separator components fixed to the inlet portion for separating the exhaust stream into two or more streams at the point of egress from the inlet portion, two or more chambers fixed to the separator components, the chambers for muffling sound of the exhaust stream, two or more collector components fixed to the chambers opposite the separator components for collecting the separated exhaust streams upon egress from the chambers, and one or more outlet portions fixed to the collector components at the end opposite the chambers for carrying separated or merged exhaust streams out of the exhaust component.

In a preferred application, the two or more separator components present a separation interface at the point in the exhaust component where they are fixed to the inlet portion, the interface characterized by one or more sharp or sharpened edges facing in the direction of the approaching exhaust stream forced through the component.

In one embodiment, the inlet portion, outlet portion, separator components, and collector components are tubing sections welded together to form the exhaust component. In one embodiment, the inlet and outlet portions are preformed on one end for enabling a minimum gap when interfacing to the separator and collector components prior to welding. In a variation of this embodiment, the preformed areas comprise inward crimps or creases formed by pressing a tool down over the inlet or outlet portion diameter, the tool having angle iron apertures welded thereto and positioned to interface with the outer edge of the inlet or outlet portion forming the crease or crimp pattern when the tool is pressed over the inlet or outlet to a predetermined stopping point.

In one embodiment, the collective volume of the separator components is equal to or greater than the inlet portion of the exhaust component. In one embodiment, the collector and separator components are interchangeable. In one embodiment, the inlet and outlet portions are interchangeable.

In one embodiment, the exhaust system further includes an exhaust stream crossover point formed by adding a doughnut configuration in between the inlet portion and separator components leading into the chambers. In a variation of this embodiment, the exhaust system includes a second separation interface, the first positioned at the top of the doughnut at the inlet and the second being at the crossover point.

According to another aspect of the present invention, using an exhaust component, the component including an inlet portion, two or more separator components fixed to the inlet portion so as to present a separation interface at the point in the exhaust component where they are fixed to the inlet portion, two or more chambers fixed to the separator components, two or more collector components fixed to the chambers opposite the separator components, one or more outlet portions fixed to the collector components at the end opposite the chambers, a method for improving sound quality of an exhaust system is provided and includes the steps (a) activating an exhaust system to produce an exhaust stream, (b) separating the exhaust stream into two or more streams, (c)

muffling the sound of the streams, (d) collecting the separate streams after muffling, and (e) merging the streams at outlet of the exhaust component.

In one aspect of the method, in step (a), activation is by powering on a vehicle. In this aspect, the vehicle is one of a diesel, gas, or hybrid vehicle. In all aspects, in step (b), the separation interface includes one or more than one sharp or sharpened edges. In one aspect of the method, in step (c), muffling is accomplished using glass pack chambers. In one aspect, in step (d), there are two, three, or four separated streams equaling the number of separator components. In one aspect, in step (e), the separate streams are merged into a single outlet portion. In another aspect, in step (e), the separate streams are merged into two separate outlet portions. In one aspect, the method further includes a step between steps (b) and (c), for crossing the separated exhaust streams at a crossover point.

BRIEF DESCRIPTION OF THE DRAWING FIGURES

DETAILED DESCRIPTION

The inventors provide a system and methods for attenuating and shaping compression pulse sound waves characteristic of exhaust gasses traveling through a vehicle exhaust system that provides signal attenuation and modification with minimal reflection to enhance pulse definition and sound quality at the point of exit of the exhaust for the exhaust component or components. The present invention is described in enabling detail according to the presented examples, which may represent more than one embodiment of the present invention.

Figure 1:
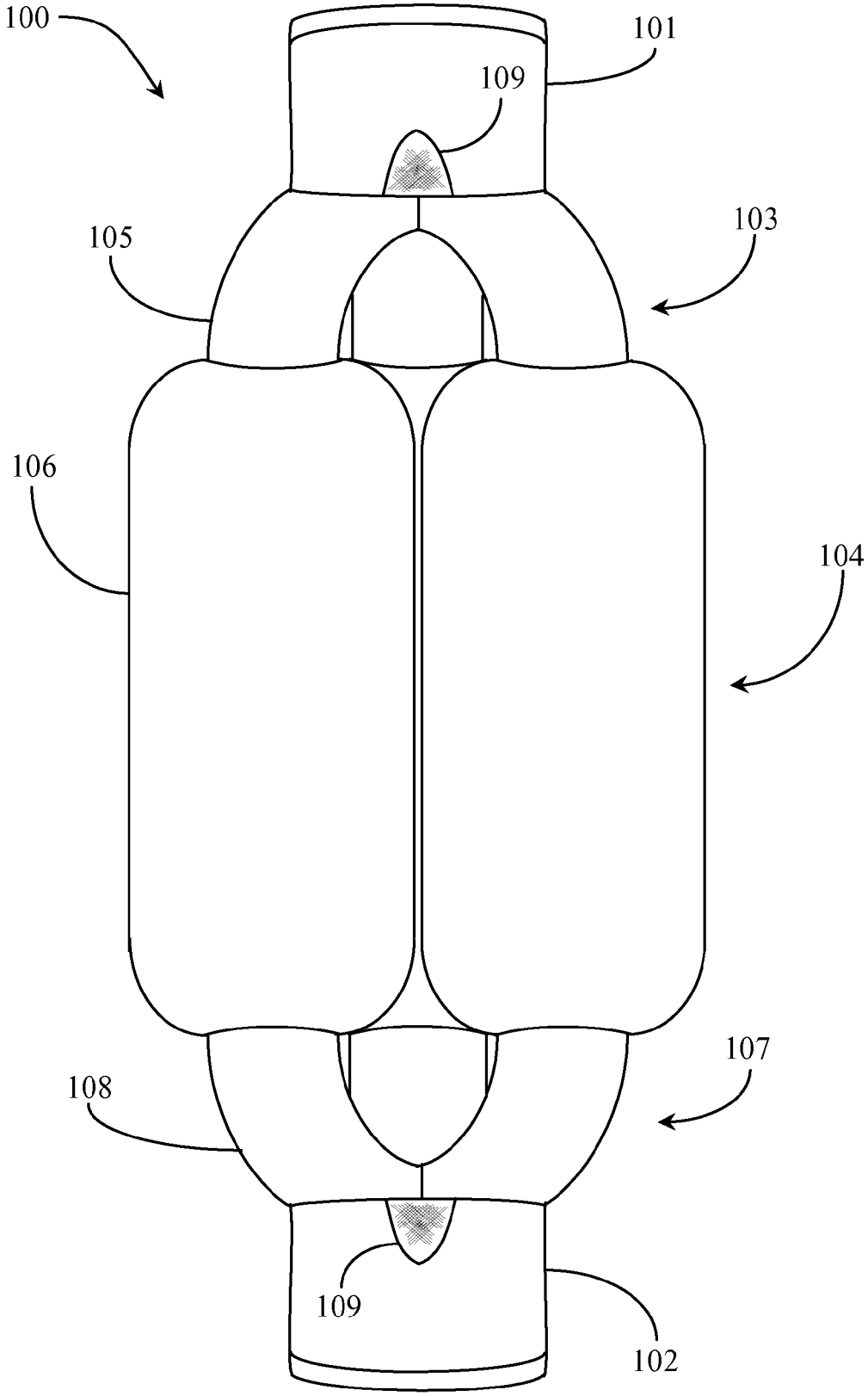
FIG. 1 is a plan view of an exhaust component according to an embodiment of the present invention.

FIG. 1 is a plan view of an exhaust component 100 according to an embodiment of the present invention. Referring now to FIG. 1, an exhaust component 100 referred to herein as a wave pulse attenuation device is illustrated in plan view. Device 100 is manufactured of a stainless steel or another suitable metal or composite for use in exhaust systems of both diesel and gas combustion engines. Device 100 is adapted to replace a stock muffler on an exhaust system of a truck or sports utility vehicle or any other vehicle where the exhaust system exhibits a 2 to 3 inch exhaust pipe diameter. Device 100 may be welded in line into an exhaust system, typically at the location of the muffler the device is meant to replace.

Device 100 has an inlet portion described in this example as a pipe 101 that may vary in diameter but generally is in the range of diameters of light to heavy-duty truck or spot utility vehicle exhaust system piping. Inlet pipe 101 may be flared out at its open end to facilitate coupling with a host exhaust system piping. Inlet pipe 101 is annular and has a nominal wall thickness consistent with normal stainless steel exhaust tubing. In one embodiment, inlet pipe 101 has a crimp or crease pattern, illustrated herein by a crimped area 109 at its interfacing edge. Crimped or creased area 109 facilitates a minimum gapping between material edges prior to welding. In this example there are three crimped or creased areas 109 equally spaced about the periphery of inlet portion, tube, or pipe 101 at 120 degrees between centerlines for the pattern.

In one embodiment inlet and outlet portions of the exhaust component are preformed to produce crimped or creased areas 109 by utilizing a ring jig with apertures welded thereto in the same 120 degree pattern required to accommodate the three separation components jigged for weld. In this case the edge of the ring jig may abut against the inlet or outlet tube edge to set the depth of the crimped areas. The vertical location of welding of the apertures to the ring jig plays a role as well. The operation may, in one embodiment, be performed using an automated machine press instead of a manual lever press or mallet operation.

A wave pulse separation interface assembly 103 is provided as a component of device 100 and comprises a plurality of separator components 105 illustrated herein as a plurality of arcurate tubes. Separator components 105 are tubes in a preferred embodiment and will hereinafter be described in this specification as tubes 105. Tubes 105 may be formed to the desired bend shape using a tube bending machine or a form-bending machine adapted for the purpose of forming or shaping tubes. Tubes 105 may be cut to length before bending or may be parted off of a longer tube during the bending process. In one embodiment, in the cutting process each tube 105 is cut diagonally and then ground at symmetrical positions on either side of the cut to create a fit relative to one or more additional pipes 105 used in the configuration.

In a typical scenario, each piece 105 may be secured in alignment against a jig placed on a grinding wheel table. Each tube may then be ground on either side of the cut line by manipulation of the position of the jig relative to the grinding wheel. Tubes 105 are relatively short in length and are welded in a substantially symmetrical triangular pattern to the bottom opening of inlet pipe 101. The diameter of tubes 105 is smaller than the diameter of inlet pipe 101 so that the initial exhaust compression wave stream, also referred to in the art as a wave pulse train (WPT) entering into the device from the engine side is separated into three WPTs wherein the wave amplitude, wavelength, and frequency of those wave pulses in each train are substantially equal to one another. The diameter of tubes 105 is held such that their collective volume is equal to or greater than the volume of inlet pipe 101 so as not to contribute to the value of backpressure that exists on the exhaust system.

The weld interface joining tubes 105 to inlet pipe 101 is performed to provide three substantially equal size openings (in this example) for the initial WPT to be separated into. Therefore the opening of inlet pipe 101 that adjoins the tubes is closed except for the three symmetrically patterned openings. A tube crimping operation using a crimping ring tool, not illustrated, is performed to create a symmetrical pattern of crimped or creased areas such as the visible crimped area 109 on the interfacing edge of inlet 101. The initial input WPT is separated into the three openings of wave pulse separator 103 by a sharp-edged wave-slicing interface (WSI). The WSI is not illustrated in this example but will be described in more detail later in this specification. The WSI is created by the welding process such that weld seams are placed adjacent to and in between the openings of tubes 105 in such a manner that the weld seams are raised above the plane of the openings and are held sharp during welding or are sharpened after welding to minimize any reflection or bounce off of wave pulse energy from the exhaust stream during refraction of the wave pulses around the obstacle and into the separator tube openings.

A sound absorption configuration 104 is provided as a component of device 101. Sound absorption configuration 104 is adapted to attenuate the wave pulse energy traveling through the device by absorbing some of the energy thereby muffling sound. Configuration 104 includes three elongate double-walled chambers 106 arrayed in a symmetrical triangular pattern with each chamber substantially parallel to the other and held flush at the ends in the configuration. Each chamber has an opening at opposing ends to allow for pass-through of exhaust gasses. In one embodiment each chamber 106 is a traditional glass pack consisting of an inner tube with a perforation pattern provided there through that extends generally along the length, around the tube diameter and, in some cases spiraling about the tube. An insulation jacket made from fiberglass, glass, or some other porous material that can absorb some of the wave pulse energy passing through each chamber is disposed between the inner and outer tubes of the chamber. Each chamber 106 represents a sound attenuator with a straight-through configuration that utilizes the principle of absorption maximally and reflection minimally to attenuate the WPT passing there through during exhaust emission.

Chambers 106 are spaced apart from one another equally leaving a small and consistent gap between them in the configuration. The bottom tube openings of wave pulse separator 103 are positioned to be centered at the openings of each chamber in the configuration. Each chamber 106 is centrally orientated and welded to each tube 105 in a manner so as not to restrict the inside passageway between each tube and the adjoined chamber. In one embodiment, the exhaust component 101 has two chambers 106 instead of three chambers 106 and two separator tubes 105 instead of three. In this case the separator tubes would be slightly larger in diameter to compensate for backpressure equalization. In another embodiment there could conceivably be four chambers provided which would require another tube 105 in the wave pulse separation assembly 103. There may be two or more chambers 106 provided with exhaust component 101 without departing from the spirit and scope of the present invention. The number four representing the number of chambers represented further above is not meant to construe a limitation.

A wave pulse collection assembly 107 is provided as a component of device 101. Wave pulse collector 107, like wave pulse separator 103 includes three arcurate collector components or "exhaust collecting" tubes 108. Tubes 108 are similar if not identical in length diameter and bend to tubes 105 and may, in one embodiment, be interchangeable parts. Hence component 107 may be component 103 inverted in orientation to perform wave pulse collection. In this case, assembly 107 may or may not include a wave-slicing interface. If the welding is performed to create a wave-slicing interface in assembly 107 then either end of device 100 may serve as an input end when installing the device inline into an exhaust system. Wave pulse collection assembly 107 collects the remaining WPTs leaving chambers 106 and directs those trains into an outlet portion, tube, or pipe 102. Outlet pipe 102 may be of the same diameter and length as inlet pipe 101 and the parts may be interchangeable. Outlet pipe 102 includes the same crimping or crease pattern represented herein by crimped or creased area 109. The crimping or crease pattern is an equally paced (EQSP) pattern whereby the centerlines for three areas reside approximately 120 degrees from one another. In an exhaust component with four tubes, there would be four areas approximately 90 degrees separation from one another.

In manufacture of device 100, pipe sections 101 and 102 are cut or parted off from a longer pipe wherein the cuts are substantially parallel. Tubes 105 and 108 may be provided with a perpendicular cut on the end interfacing with the chamber and an angled cut at the end welded to the inlet/outlet pipe. The angle of this cut is such that during bending the tube ends are brought into parallel relationship with each other at the correct bend angle, which may be about 20 degrees. The degree of bending may be more or less than 20 degrees without departing from the spirit and scope of the present invention. In order to preserve the symmetry of device 100 the bend angle should be substantially consistent for all of the tubes. Device 100 is assembled and welded on a jig or other suitable fixture that facilitates the correct positioning of the parts to be welded together. During welding, no openings are left in the device other than the intended exhaust flow passages. Likewise, additional cut-grinding to shape the WSI is performed using a positional jig for positioning each tube to be ground to a specific depth on either side of the tube along the angled cut line. The just-describe operation facilitates the alignment of the WSI edges together in the assembly before welding.

Wave pulses of a WPT traveling down the exhaust system from the engine enter inlet pipe 101 and are separated into three substantially equal WPTs with the aid of the wave-slicing interface (WSI) mentioned further above. The wave-slicing interface provides a sharp-edged interface that the waves may refract around with minimal to no wave reflection. This important feature of the present invention acts to provide a cleaner separation of the wave pulses. The separated WPTs are then channeled or guided along the arcurate tubes 105 in the direction of each tube into sound absorption device 104 consisting of chambers 106. The amount of energy loss from the WPTs traveling through each chamber is substantially equal for each chamber. Minimal or no wave reflection between inlet pipe 101 and chambers 105 functions to retain a more clean definition of each pulse with less noise between pulses. All three WPTs lose an equal amount of wave energy through absorption in attenuation device 104. However minimal reflection within chambers 106 helps to maintain the definition between pulses within each wave pulse train.

At interface 107, the separate WPTs are redirected or focused toward one another with the aid of collector 107. The resulting output from outlet 102 is a modified set of wave pulses that, because of the direction of convergence, do not mimic the original WPT entering the device. The resulting sound output can be described as a harmonic set of WPTs emanating from the exhaust outlet. The direction of compression is slightly different for each compression wave passing through into outlet 102. It has been determined through empirical testing that the human ear perceives the modification as a smoother cleaner pulse that has a harmonic or stereo effect instead of a monolithic effect. In other words, the human ear perceives the sound, as clearly audible sound pulses at a reduced decibel with a harmonic component that makes the sound richer than it would otherwise be just traveling straight through a glass pack.

Figure 2:
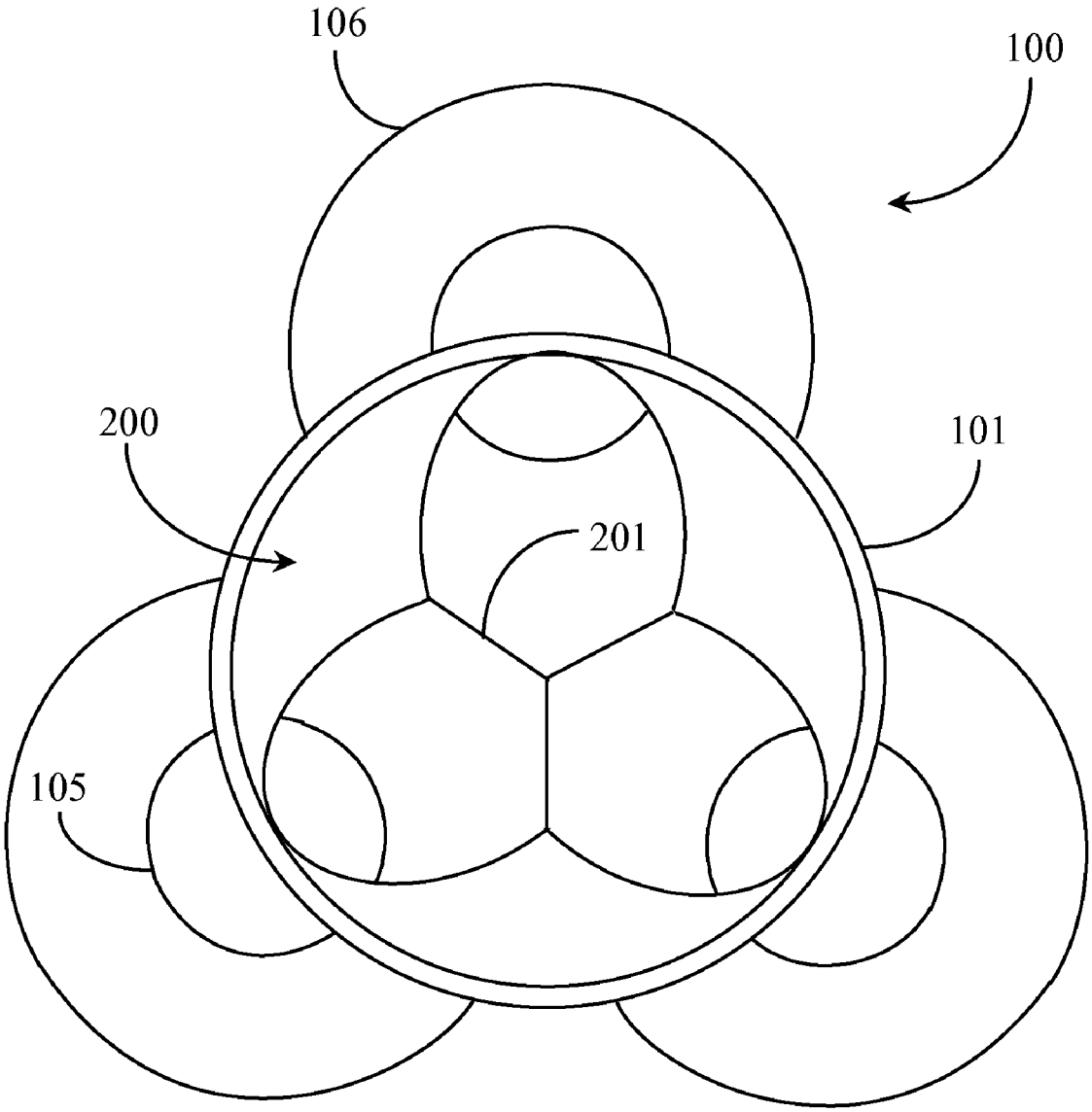
FIG. 2 is an end view of the exhaust component of FIG. 1.

FIG. 2 is an end view of the exhaust component 100 of FIG. 1. Referring now to FIG. 2, component 100 is illustrated from the perspective of looking into the device from the open end of inlet pipe 101. Chambers 106 and separation tubes 105 are visible from this perspective. A wave-slicing interface (WSI) 200 is illustrated in this example and was described further above with respect to FIG. 1. WSI 200 connects the interfacing edges of the three tube ends (105) together at the bottom opening of inlet pipe 101. This interface is characterized by three substantially linear weld seams 201 that are purposely raised above the plane of the openings in a manner that produces a triangular or pyramidal ridge that culminates at a center point 201 that has a pyramidal profile. The exhaust-facing surfaces of seams 201 are held sharp during welding operation or later sharpened after the welding operation.

The sharp-edge characteristic of interface 200 may be further enhanced by an edge grinding operation after welding to clean up any globules left over by the welding rod, if any. The WSI reduces or eliminates wave reflection back upon itself, which may lend to reduce noise and may maintain a minimal decibel level of noise between distinct wave pulses representing the engine exhaust sound. It is noted herein that the sharpened interfacing edges hold advantage over rounded or flat surfaces that may act to reflect wave pulses back on themselves or otherwise bounce wave pulses around thus compromising exhaust pulse sound quality by raising noise ratio and muddling the sound quality. The edge of WSI 200 provides a much cleaner separation of the wave energy than a flat, concave or convex surface would. The overall size of WSI 200 is smaller than the wavelength of the compression wave train enabling sufficient wave refraction around the obstacle and into the wave pulse separation tubes. In one embodiment of the present invention, the wave separation tubes 105 may be elliptical or oblong approaching rectangular instead of round without departing from the spirit and scope of the present invention. All three tubes should have the same geometric configuration to maintain equal wave pulse propagation and shaping.

It is important to note herein that a wave-slicing interface such as WSI 200 may be implemented by interfacing two or more plates or walls together with edges ground to form a sharp edge interface that faces the oncoming exhaust stream coursing through the exhaust component such as within a channel constructed and welded into a rectangular jacket or case in order to obfuscate the use or application of tubing without departing from the spirit and scope of the present invention.

Figure 3:
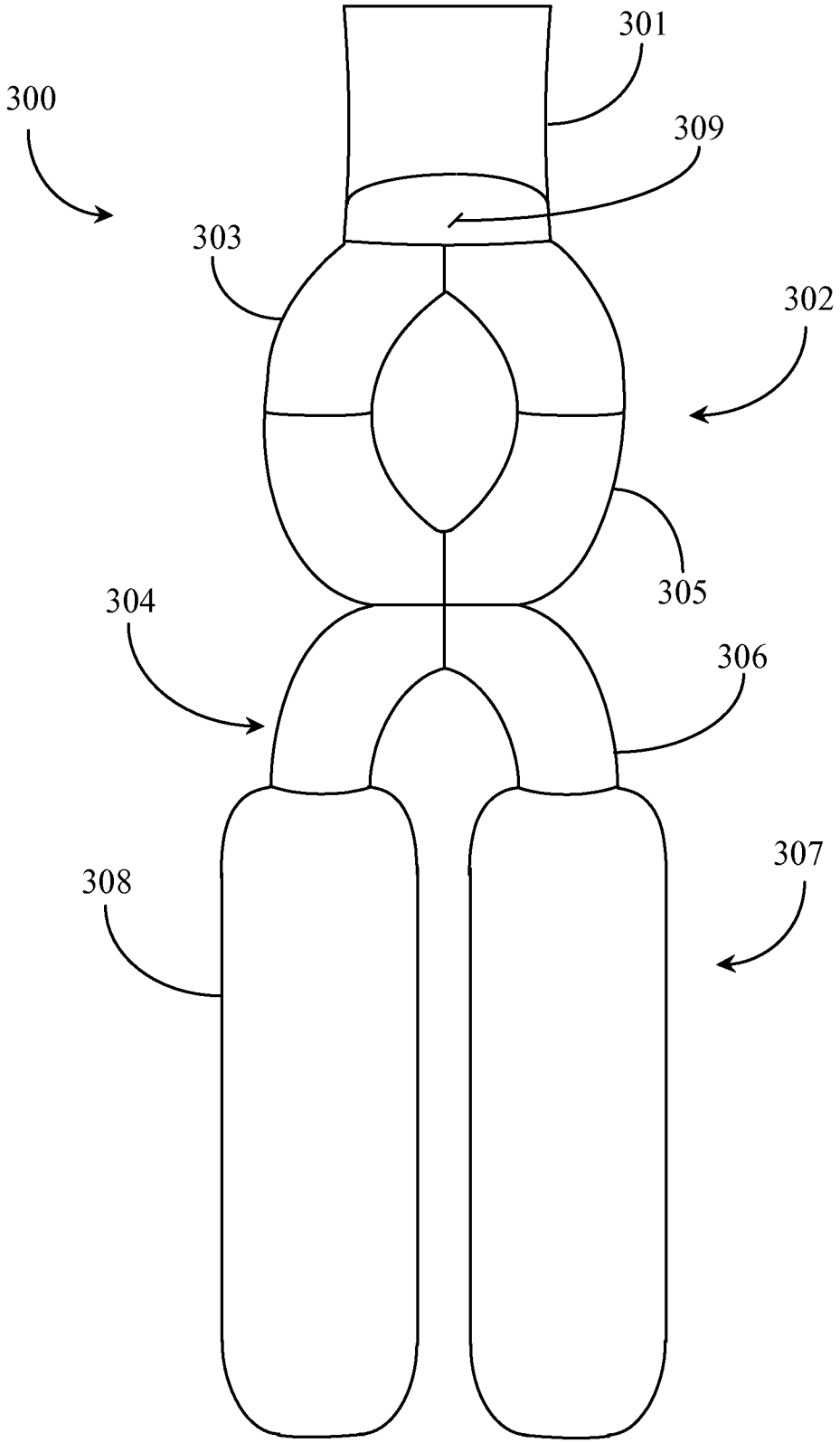
FIG. 3 is a plan view of an exhaust component exhibiting a dual outlet architecture and exhaust gas crossover point according to a version of the invention embodiment of FIG. 1.

FIG. 3 is a plan view of an exhaust component 300 exhibiting a dual outlet architecture and exhaust gas crossover point according to a version of the invention embodiment of FIG. 1. Referring now to FIG. 3, exhaust component or wave pulse attenuation device 300 is illustrated in plan view. Component 300 like component 100 is adapted to be installed in an exhaust system line replacing the stock muffler system normally used to deaden engine exhaust sound. Device 300 may be used in exhaust systems of light trucks and cars having duel exhaust systems.

Device 300 includes an inlet pipe 301 adapted to be welded inline in the exhaust system before the system splits leading to duel exhaust pipes. Inlet pipe 301 is annular with a relatively thin wall and may be flared out at the open end. The diameter of inlet pipe 301 may vary in dimension, however nominally the pipe may be between two and three inches in diameter. Larger and smaller diameters are feasible and are considered.

Device 300 includes a doughnut portion 302 that is welded to one end of the pipe in a manner that produces a WSI (not illustrated) at the junction of inlet pipe 301 and doughnut 302. In this example, doughnut 302 comprises four arcurate tubing sections that fit together to form the doughnut configuration. Gas separator tubes or components 303 are welded together and at the end of inlet pipe 301 and are adapted to carry substantially equal portions of a separated compression wave train through the top half of the doughnut. Doughnut 302 includes arcurate gas conversion or collection components or tubes 305 welded to tubes 303 to complete the doughnut configuration 302. Tubes 305 are adapted to redirect the separated wave pulse trains to intersect at the outlet of doughnut portion 302. Tubes 303 and 305 may be about one half or greater than one half of the diameter of inlet pipe 301 but generally not any smaller than one half of the inlet pipe diameter so as not to create more backpressure in the exhaust system. One to one and one-half inch diameter is considered and each tube is of the same diameter in configuration.

A half doughnut configuration 304 is provided and is welded to the end of doughnut 302 in this example. Half doughnut 304 comprises two arcurate tubing sections 306 that fit together to form the half doughnut configuration. Tubing sections 306 are welded to the bottom openings presented by tubing sections 305 to form a wave train intersection or "crossover" point between doughnut 302 and half doughnut 304. The separate wave trains of compression wave pulses collide at an approximated 45-degree angle toward egress of device 300. Inlet portion or tube 301 has a compressed area 309 provided generally about the interfacing edge of the tubing or pipe to facilitate minimum gapping during the welding operation. In one embodiment this is accomplished by placing the tubing or pipe section 301 vertically into a table vise having a step piece to set the depth of the deformed area (309). The specific amount of vice closure as determined by handle position and number of complete handle rotations determines the stopping point in compressing the end of the tube upon itself. The tube end becomes oblong and fits the separator component end configuration such that welding may be performed with minimum gapping between the components.

Device 300 includes two sound deadening chambers 308 held substantially parallel and in the same plane as one another and flush at the edges in a chamber configuration 307. Chambers 308 may be double-walled glass packs as described further above with respect to FIG. 1. Chambers 308 come in a variety of diameters and may be selected to match the diameter of inlet pipe 301. Chambers 308 may be larger in diameter or smaller in diameter than inlet pipe 301 without departing from the spirit and scope of the present invention.

In this configuration, compression wave pulses are separated by the WSI as they pass from inlet pipe 301 into the top half of doughnut section 302. The wave-slicing interface cleanly separates the wave energy with minimum to no reflection of sound waves. Each wave train is directed around the doughnut configuration separating at the top half and converging at the bottom half. The compression waves traveling through device 300 intersect at an acute angle presented by the bottom half of doughnut section 302. Some of the sound waves deflect off one another when two wave pulses intersect, those waves deflected into their own side of the half doughnut 304. Some of the sound waves pass through to the opposite side opening having dodged deflection. The crossover point functions as a wave pulse equalizer.

In this example two substantially equal wave pulse trains enter into respective sound deadening chambers 308 where the waves relax into the larger diameter and are partially absorbed lessening the decibel value of each train by a substantially equal amount. The example represents a device installed in a duel exhaust system so the egress of the compression waves from chambers 308 continues on through separate exhaust pipes to atmosphere. The effect of dual exhaust preserves the stereo component of the enhanced exhaust sound emanating from the component.

Figure 4:
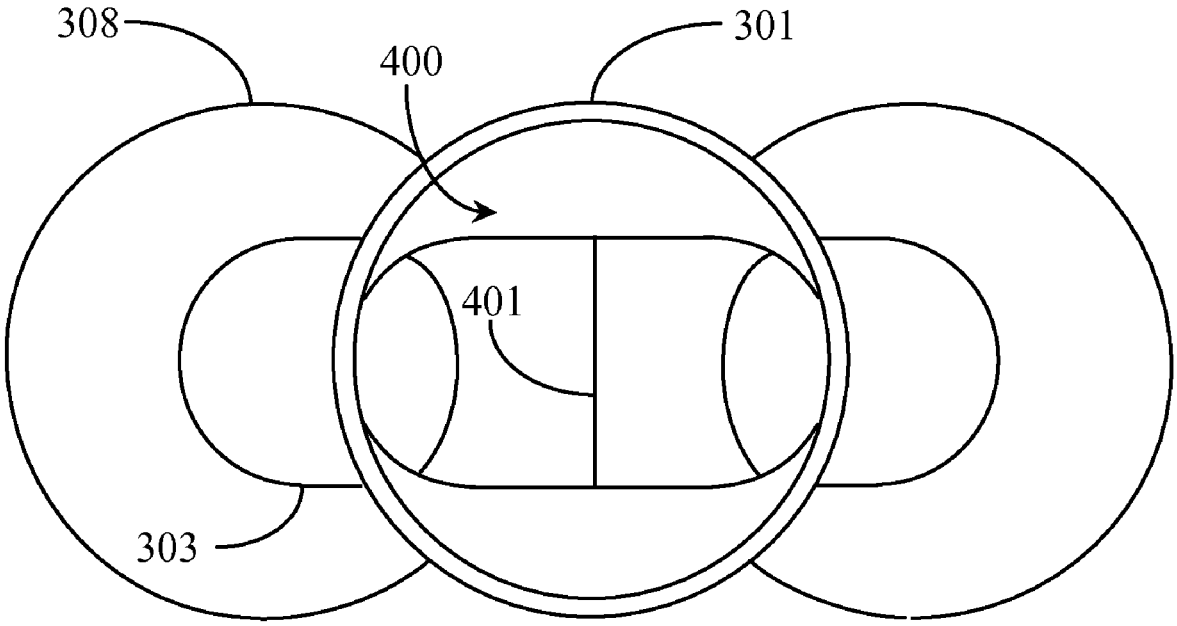
FIG. 4 is an end view of the exhaust component of FIG. 3.

FIG. 4 is an end view of the exhaust component of FIG. 3. Referring now to FIG. 4, component 300 is seen in top view looking down into inlet pipe 301. A WSI 400 is provided by producing a sharp linear weld seam 401 that projects upward from the plane of the openings into tubes 303. WSI 400 is created from the welding of two tubes 303 to inlet pipe 301 creating the separation channels. Interface 401 provides an even division of the wave pulse train into the provided openings dividing the train into two separate wave pulse trains. The symmetry of device 300 allows for equal distribution of the separate pulse trains at the same speed through the device to a crossover point. The compression fronts of each compression wave of each train pass into the crossover at substantially the same time causing the compression wave interaction that further breaks up the wave energy and equalizes the energy for a clean and pulse separated egress from the device. In this case the angled cuts on the interfacing ends of tubes 303 are ground differently (once on interfacing edge) because there are only two instead of three tubes in the assembly.

Figure 5:
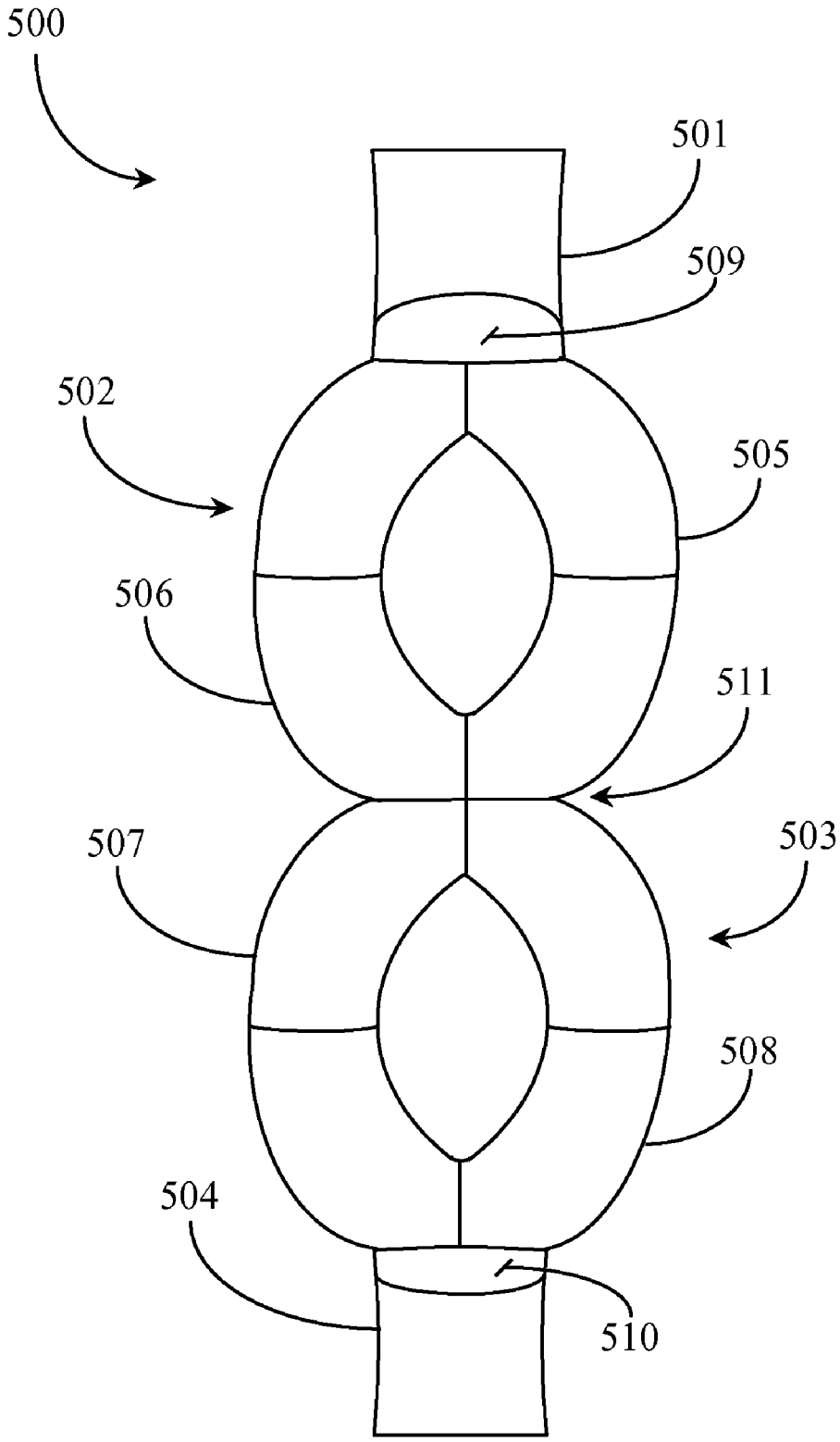
FIG. 5 is a plan view of an exhaust component exhibiting a single outlet architecture and exhaust gas crossover point according to a version of the invention embodiment of FIG. 1.

FIG. 5 a plan view of an exhaust component exhibiting a single outlet architecture and exhaust gas crossover point according to a version of the invention embodiment of FIG. 1. Referring now to FIG. 5, an exhaust component or "sound shaping and attenuation" device 500 is provided in plan view. In this example, device 500 is adapted primarily for a stock exhaust system and does not replace the muffler system. Device 500 is installed in line on the engine side of the muffling system and may be added in addition to a stock resonator or in place of a stock resonator. In an embodiment where the exhaust system is a duel exhaust system having to muffler lines; two devices may be installed ahead of the muffler, one per line.

Exhaust component 500 includes an inlet portion or pipe 501. Inlet pipe 501 is annular and has a relatively thin wall. Inlet pipe 501 may have a nominal diameter ranging from one and one-half inches to two or more inches. Inlet pipe 501 may be larger or smaller in diameter than the stated range without departing from the spirit and scope of the present invention. Inlet portion 501 is preformed before welding to deform the interfacing edge so as to reduce gapping around the separator tube configuration as described further above in the description provided with FIG. 3. The deformity is illustrated in this example as a deformed area 509. Deformity 509 causes the end of tube 501 to present an oblong interface that substantially matches the oblong configuration of the separator tubing ends jigged for welding. As described previously with respect to inlet portion 301, the depth and amount of deformity applied to inlet portion 501 is controllable by a vice application. In one embodiment such preparation steps and processes are automated using automated press machines or similar equipment and material jigs.

A first doughnut section 502 is provided as a component of component 500 and comprises two arcurate tubing sections 505 also referred to herein as separation tubes 505 and two arcurate tubing sections 506 also termed convergence or collector components or tubes 506. Doughnut 502 is welded to inlet pipe 501 in a manner as to create a WSI (not illustrated) analogous to the interface described with respect to FIG. 4 above. The interface is produced by provision of a linear weld seam that is raised above the openings presented by the top portion of the doughnut and that is sharp along the center of the seam. As previously described above, a sharpening operation achieved by grinding, for example may produce a sufficiently sharp edge for wave slicing or the weld seam may simply be held clean and sharp on the inside edge during the welding operation. In one embodiment the sharp edge is maintained by the natural upward protrusion of the tube ends which may be left sharp in the inside part of the weld.

Separation tubes 502 and convergence tubes 506 may be interchangeable pieces. The diameter of tubes 505 may be equal to or greater than the radius of inlet pipe 501 so as to prevent added backpressure. In all of the case examples described, the arcurate separation tubes have a combined volume that is equal to or grater that the volume of the inlet pipe.

A second doughnut section 503 is provided as a component of device 500 and comprises two arcurate tubing sections 507 also referred to herein as crossover tubes 507 and two arcurate tubing sections 508 also termed convergence or collector tubes 508. Second doughnut section 503 is welded to the first section to form a compression wave crossover point analogous to the crossover point described with reference to FIG. 3. Second doughnut 503 may be dimensionally similar or the same as first doughnut section 502.

Device 500 as the other devices described above may be manufactured of stainless steel tubing or some other metal suitable for exhaust system function. In this example, the sound wave pulse train entering into inlet pipe 501 is sliced into to separate sound wave pulse trains by the wave-slicing interface. The interface provides a sharp interface smaller than the wavelength of the sound waves in the inlet pipe keeping reflection to a minimum. The separated wave trains are directed away from each other at the top of first doughnut 502 and are brought toward one another at the bottom half of the first doughnut.

Welding the two doughnut sections together at the bottom end of the first doughnut section 502 and top end of the second doughnut section 503 creates a crossover junction 511. As described earlier, the separate compression wave trains intersect at an acute angle. As previously described above, the compressed wave fronts come into contact at the crossover point. The contact breaks up and equalizes the two wave trains. Some of the energy from each wave is deflected back into its own side of the doughnut structure while some of the energy crosses over to the other side of the doughnut structure. This effect causes a compression wave of less strength but with cleaner separation between waves in the same respective wave train. After the waves pass through the crossover point, separation tubes 507 of the second doughnut section direct them about the second doughnut into the convergence tubes 508.

Convergence tubes 508 function together to merge the separate wave trains together in the same outlet portion or pipe 504. The angle of presentation of the waveforms in the outlet pipe 504 is such that the waveforms are slightly distorted and do not exactly line up with one another causing a harmonic effect at the outlet pipe that is not changed by the muffler system. The muffler system in this case quiets the sound but does not create noise between the defined wave pulses of the wave train. It is noted that outlet portion 504 is preformed as was described relative to inlet portion 501, in essentially the same or similar manner already described.

Figure 6:
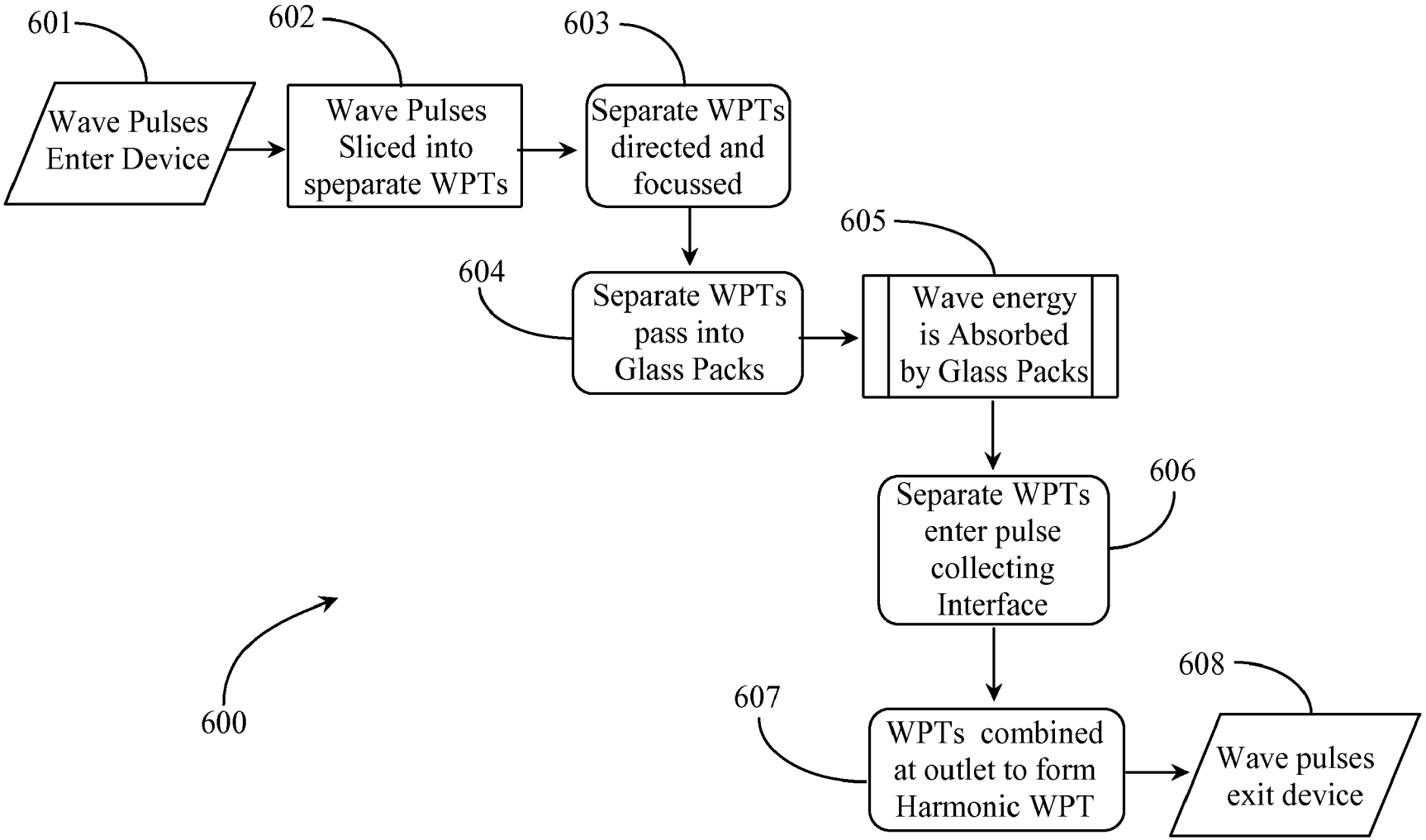
FIG. 6 is a process flow chart 600 illustrating steps for processing gas exhaust according to the invention embodiment of FIG. 1.

FIG. 6 is a process flow chart 600 illustrating steps for processing gas exhaust according to the invention embodiment of FIG. 1. Referring now to FIG. 6, a process flow is described that refers to the exhaust component of FIG. 1 of this specification. At step 601 the wave pulse train from the engine enters the exhaust component or sound-shaping device. At step 602 the wave pulse train is separated into multiple wave pulse trains by the wave-slicing interface. In this step the wave-slicing interface may comprise a single raised and sharp linear weld seam or multiple raised and sharp weld seams converging to a central point depending on the number of separation channels the original wave pulse is divided into.

The separate wave pulse trains or feeds are channeled and focused through the separation tubes at step 603 and pass into sound absorption chambers at step 604. It is noted herein that there may be two or more absorption chambers connected in configuration without departing from the spirit and scope of the present invention. At step 605, wave energy is absorbed by the sound absorption chambers with minimal reflection occurring.

At step 606 the separate wave pulse trains pass from the chamber configuration into a wave collection interface analogous to the interface 107 of FIG. 1. At step 607, the wave pulses are channeled and merged to egress wherein the merged compression wave train exits the device to exhaust.

Figure 7:
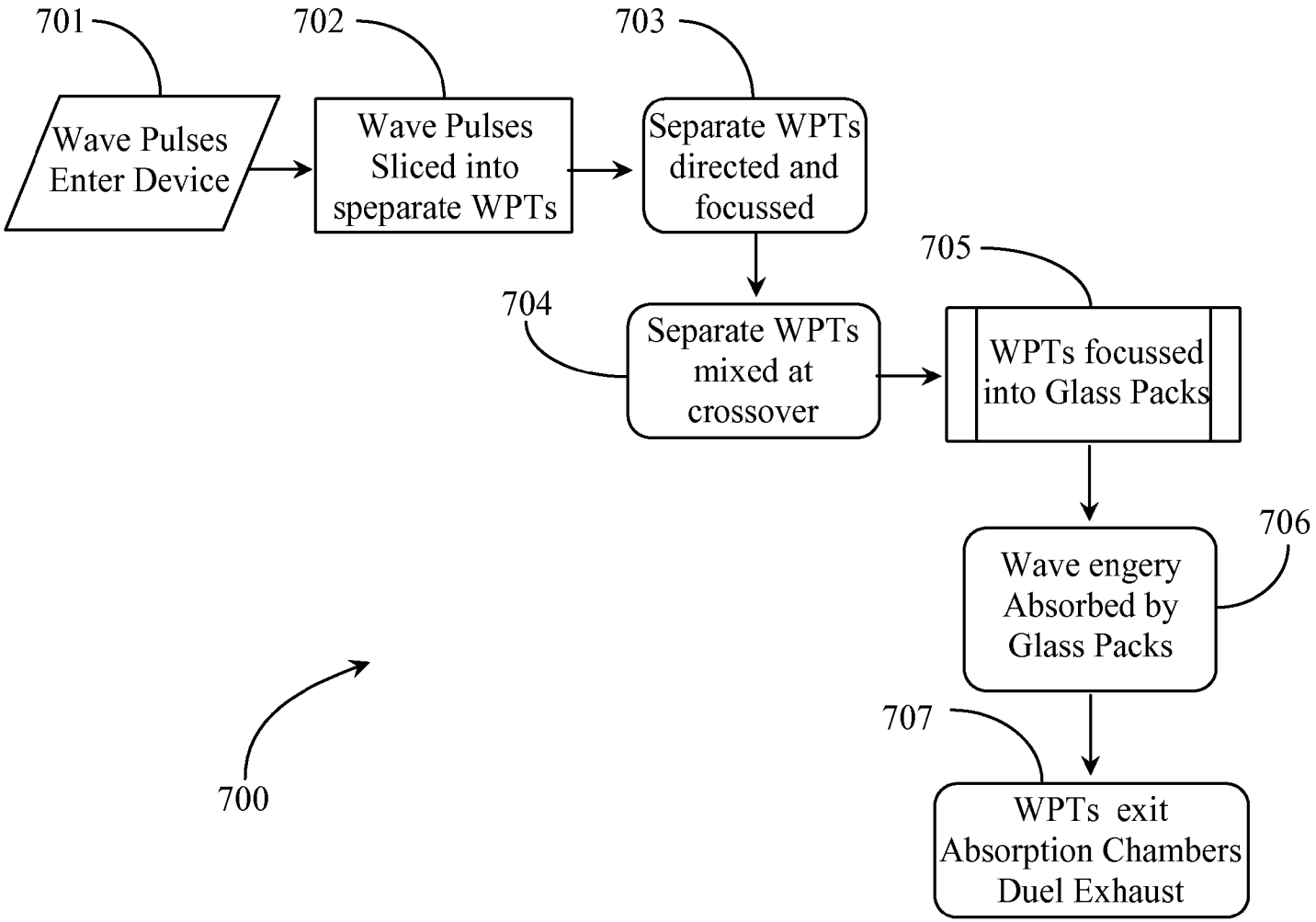
FIG. 7 is a process flow chart 700 illustrating steps for processing gas exhaust according to the invention embodiment of FIG. 3, a version of the invention embodiment of FIG. 1.

FIG. 7 is a process flow chart 700 illustrating steps for processing gas exhaust according to the invention embodiment of FIG. 3, a version of the invention embodiment of FIG. 1. Referring now to FIG. 7 a process flow is provided that refers to the example of FIG. 3. At step 701*a* wave pulse train containing compression waves enters into the device at the inlet pipe. At step 702 the wave pulses are sliced into separate wave pulse trains (WPTs). The separation is achieved cleanly with minimum or no reflection via the sharp interfacing edged of the wave-slicing interface (WSI). At step 703 the separate WPTs are directed and focused around a doughnut configuration. At step 704 the separate WPTs mix at a crossover point formed by welding a half doughnut to the full doughnut. In this step some of the sound wave energy is deflected back to the same side of the doughnut configuration and some of the sound wave energy crosses over into the opposite channel for both WPTs.

At step 705 the separate WPTs are directed by separation tubes into absorption chambers, which may be glass packs. At step 706 the absorption chambers absorb some of the compression wave energy reducing the strength of the wave pulse trains. At step 707 the WPTs exit the absorption chambers and are exhausted through duel exhaust pipes as separate WPTs.

Figure 8:
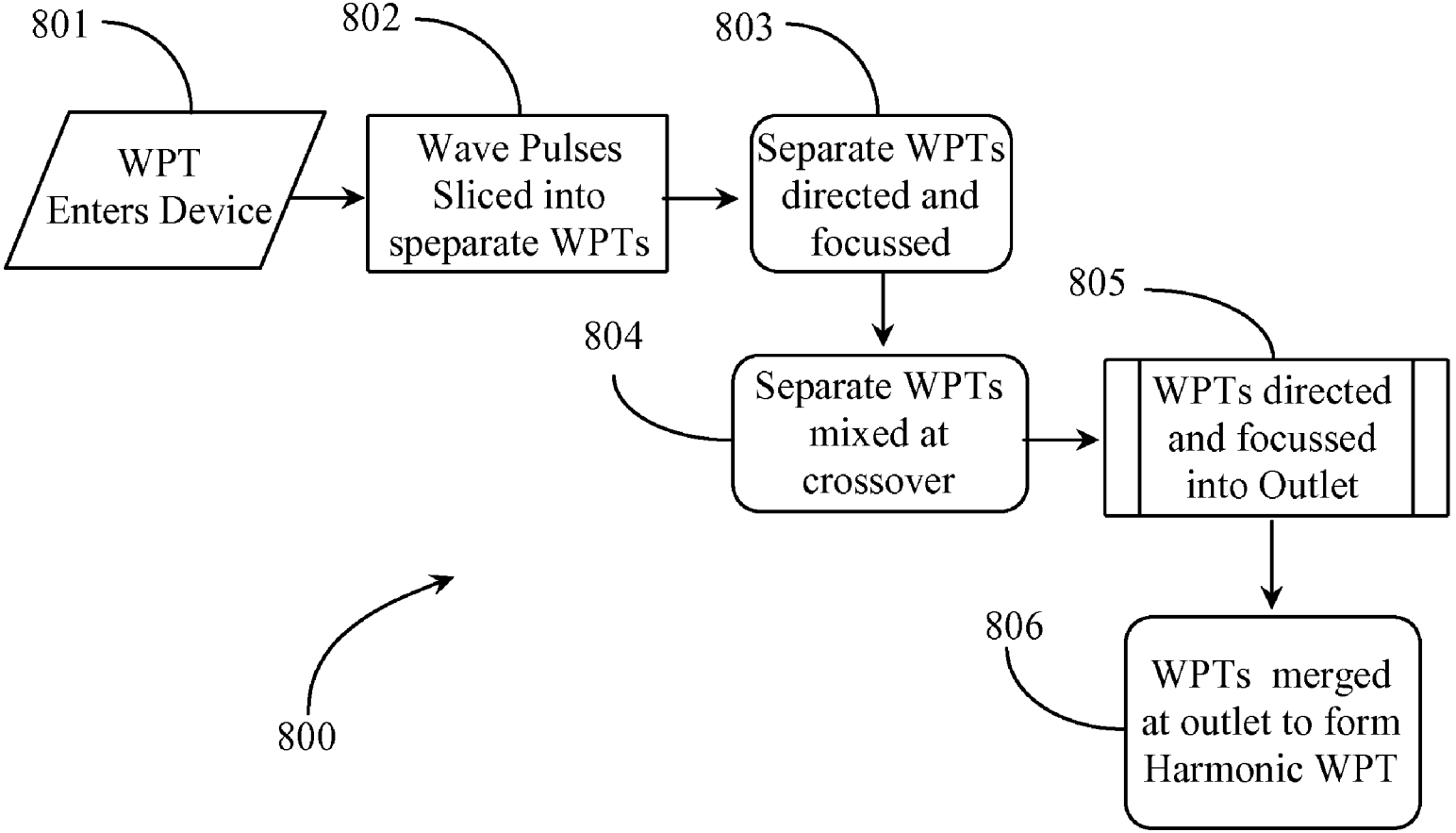
FIG. 8 is a process flow chart 800 illustrating steps for processing gas exhaust according to the invention embodiment of FIG. 5, a version of the invention embodiment of FIG. 1.

FIG. 8 is a process flow chart 800 illustrating steps for processing gas exhaust according to the invention embodiment of FIG. 5, a version of the invention embodiment of FIG. 1. Referring now to FIG. 8 a process flow is illustrated that refers to the device of FIG. 5. At step 801*a* WPT coming from the engine enters the device. At step 802 the compression wave train is sliced into separate WPTs. At step 803 the separate WPTs are channeled or directed and focused through a first doughnut. At step 804 the separate compression wave trains are caused to mix at a crossover point created by welding two doughnuts together in the configuration of an eight.

At step 805 after the crossover point the mixed but still separated wave trains are channeled or directed and focused back towards the outlet pipe. At step 806 the separate WPTs are merged at the outlet pipe to form a single harmonic WPT.

It will be apparent to one with skill in the art that all of the exhaust component versions thus far described act, during exhaust output, to slice an original rough compression wave pulse train into substantially equal and separate WPTs that can be further manipulated before egress of the compression waves from the exhaust system. It will also be apparent to the skilled artisan that the function of remerging the separate WPTs produces some back-end harmonic effect. In one embodiment of the present invention the stainless steel tubing used to manufacture the various configurations of the device may be internally coated with a zinc compound or other metallic coating to create a smoother inner surface with lower porosity factor and fewer anomalies. Likewise, the exterior of the device may be coated as well for cosmetic appeal.

More than one of the devices of the present invention may be used in a single exhaust system without departing from the spirit and scope of the present invention. In one embodiment where the exhaust system is a duel exhaust, two devices may occupy the tail end portions of the exhaust behind a crossover if present. In some embodiments the stock mufflers in stock exhaust systems are removed and replaced with the device of the present invention. In other embodiments the device of the invention in certain configuration may be used in addition to the stock muffler.

It will be apparent to one with skill in the art that the sound shaping device and system of the invention may be provided using some or all of the mentioned features and components without departing from the spirit and scope of the present invention. It will also be apparent to the skilled artisan that the embodiments described above are specific examples of a single broader invention, which may have greater scope than any of the singular descriptions taught. There may be many alterations made in the descriptions without departing from the spirit and scope of the present invention.

What is claimed is:

1. An exhaust assembly comprising:

A first single conduit capturing a first exhaust stream;

a second and a third conduit welded at a common juncture to the first conduit separating the exhaust stream into second and third exhaust streams wherein conduit edges in the juncture facing the first exhaust stream are welded such that the weld seams are raised above the plane of the openings and are held sharp during welding or are sharpened after welding minimizing reflection of sound waves of the first exhaust stream;

a fourth conduit welded to the second and third conduits collecting the second and third exhaust streams into a fourth exhaust stream; and an outlet port from the fourth conduit expelling the fourth exhaust stream.

2. The exhaust assembly of claim 1 wherein four conduits are tubing sections welded together to form the exhaust assembly.

3. The exhaust assembly of claim 1 wherein the collective volume of the second and third conduits is equal to or greater than the collective volume of the first conduit.

4. A method for improving sound quality of an exhaust system comprising the steps of:

(a) capturing a first exhaust stream in a first single conduit;

(b) separating the exhaust stream into separate second and third exhaust streams in each of second and third separate conduits at a juncture wherein welded conduit edges in the juncture facing the first exhaust stream are welded such that the weld seams are raised above the plane of the openings and are held sharp during welding or are sharpened after welding, minimizing reflection of sound waves of the first exhaust stream;

(c) muffling the sounds of the separated streams;

(d) collecting the separated streams after muffling into a fourth conduit; and (e) expelling the merged streams at an outlet port.

5. The method of claim 4 wherein in step (b), the separation interface includes one or more than one sharp or sharpened edges.

6. The method of claim 4 wherein in step (c), muffling is accomplished using glass pack chambers.

* * * * *